United States Patent [19]

Gaber

[11] 4,091,247

[45] May 23, 1978

[54] DOUBLE POLE-DOUBLE THROW SWITCH

[76] Inventor: Martin Gaber, 2301 Greenwood, Wilmette, Ill. 60091

[21] Appl. No.: 695,937

[22] Filed: Jun. 14, 1976

[51] Int. Cl.[2] ..... H01H 21/00

[52] U.S. Cl. ..... 200/67 G; 200/68; 200/159 R; 200/340

[58] Field of Search ..... 200/16 R, 16 C, 16 D, 200/16 F, 159 R, 284–286, 293, 294, 295, 340, 67 G, 67 PK, 68

[56] References Cited

U.S. PATENT DOCUMENTS

| | | | |
|---|---|---|---|
| 3,072,757 | 1/1963 | Gluck | 200/16 D |
| 3,439,138 | 4/1969 | Braun | 200/67 G |
| 3,694,590 | 9/1972 | Otterlei | 200/16 C |
| 3,740,500 | 6/1973 | Garrett et al. | 200/16 C |
| 3,757,060 | 9/1973 | Ianuzzi et al. | 200/16 C |
| 3,783,204 | 1/1974 | Kennedy et al. | 200/16 D |
| 3,805,005 | 4/1974 | Wilkinson et al. | 200/284 |

*Primary Examiner*—Samuel W. Engle
*Assistant Examiner*—Ralph Palo
*Attorney, Agent, or Firm*—McDougall, Hersh & Scott

[57] ABSTRACT

A switch construction including a base with first and second pairs of spaced-apart contacts attached to the base and a pair of spaced-apart fulcrum contacts positioned intermediate the pairs of contacts. A pair of bridging contactors is mounted for pivoting movement on the fulcrum contacts for selectively engaging one of the pairs of contacts. The bridging contactors are supported by a rocker and a spring loaded actuator is provided for driving the rocker between the selective engaging positions. The rocker and bridging contactors are assembled so that free movement therebetween is provided to thereby achieve positive engagement of contact surfaces.

13 Claims, 11 Drawing Figures

DOUBLE POLE-DOUBLE THROW SWITCH

This invention relates to a switch construction and, in particular, to a switch of the so-called double pole-double throw variety. The switch construction is particularly characterized by a spring loaded actuator operation, and the design is such that a single actuator mechanism is utilized in a highly efficient manner for controlling all contact positions of the switch.

Various switch designs have been proposed wherein single spring and piston mechanisms, rocker mechanisms, toggle actuation, spring loaded hammers and various other designs have been utilized. It has been found, however, that designs of these types are usually not suited for use as double pole-double throw switches. The actuating mechanisms in particular will not efficiently control separate bridging contactors particularly when a high degree of switching reliability is required. Accordingly, double pole-double throw switches having actuating mechanisms of the type described have not been utilized in many instances where an effective design of that type would be desirable.

It is a general object of this invention to provide an improved double pole-double throw switch construction.

It is a more specific object of this invention to provide a switch construction of the type described which is suitable for actuation by a single spring and piston, toggle, rocker hammer or other available actuating mechanisms.

These and other objects of this invention will appear hereinafter, and for purposes of illustration, but not of limitation, specific embodiments of the invention are shown in the accompanying drawings in which.

The switch construction of this invention generally comprises a base member with first and second pairs of spaced apart contacts attached to the base. A pair of fulcrum contacts is positioned on the base between the other pairs of contacts, and a pair of bridging contactors engage the fulcrum contacts and extend on either side thereof for selective engagement with the first and second pairs of contacts.

The bridging contactors are supported by a rocker. This rocker is in turn engaged by a spring loaded actuator whereby the rocker can be pivoted between respective positions. The contactors supported by the rocker are moved thereby to the respective contact engaging positions. Particularly because of freedom of movement which characterizes the assembly of the rocker and bridging contactors, the arrangement described is particularly capable of providing definite engagement of critical contact surfaces whereby a reliable double pole-double throw switch is achieved.

Figure 1:
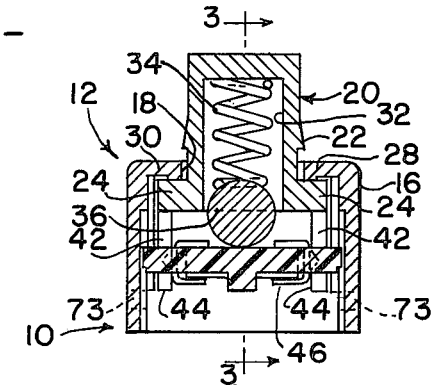
FIG. 1 is a vertical sectional view of a slider assembly portion of a switch construction characterized by the features of this invention.
Figure 2:
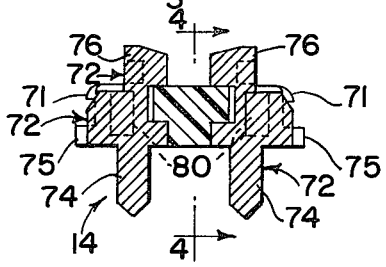
FIG. 2 is a vertical sectional view of the base of the switch construction.
Figure 3:
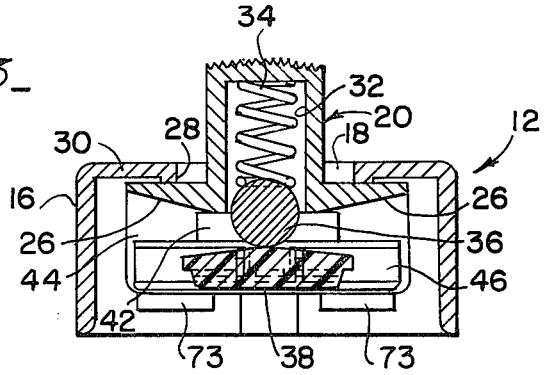
FIG. 3 is a cross-sectional view of the slider assembly taken about the line 3—3 of FIG. 1.

The switch construction 10 illustrated in the accompanying drawings is characterized by the features described above. This construction comprises a top assembly 12 and a base assembly 14. The top assembly is particularly illustrated in FIGS. 1 and 3, and it comprises an enclosure 16 defining an opening 18 in its top wall. A slider 20 is associated with the enclosure with the upper portion of the slider being exposed through the opening 18 whereby the slider can be moved back and forth manually relative to the enclosure.

The side walls of the slider define nibs 22 whereby the slider can be snapped into position by pressing the slider upwardly through the opening 18. The slider and enclosure are formed of a suitable plastic material whereby resilient characteristics are provided for purposes of achieving such fitting assembly operations.

The slider defines shoulder portions 24 along its sides, and longer shoulders 26 extending from each end whereby upper slider surfaces are provided for bearing against the rectangular ridge 28 defined on the underside of the top wall 30 of the enclosure. In addition, the slider defines an open interior portion 32 for receiving spring 34. A ball 36 is positioned partially within the interior portion for engagement with the bottom end of the spring 34.

The ball 36 is pressed by means of the spring 34 against the top surface of rocker 38, this rocker also being formed of a suitable plastic insulating material. The rocker is also illustrated in FIGS. 5–8, and it will be noted that wing portions 40 are formed on each side of the rocker. These wing portions are received within openings 42 defined by the downwardly depending walls 44 of the slider 20.

The rocker carries a pair of channel-shaped bridging contactors 46. These bridging contactors each define punched-out central openings 47 whereby the contactors will fit over the wings 40 of the rocker 38. The punching operation should provide a contactor opening large enough relative to the width of the wings 40 whereby the bridging contactors will have freedom of movement relative to the rocker 38 as will be more particularly explained. The upper wall of the bridging contactors may be cut-out as illustrated to avoid any interference with the movement of ball 36, particularly in cases where a larger diameter ball may be utilized.

The rocker 38 includes a pair of protrusions or beads 39 on each end thereof, and a pair of curved sections 41 in intermediate locations of the rocker. The latter are separated by means of reinforcing rib 43. The top surface of the rocker is upwardly sloped to a center line comprising the crest 45.

As more particularly set forth in Spedale application Ser. No. 495,936, filed on June 14, 1976, and entitled "Slide Switch Construction", the top assembly 12 is provided by assembling the rocker and bridging contactors, and the spring and ball, within the slider 20. The top assembly is associated with the enclosure 16 and then connected to the base assembly 14.

The enclosure 16 (FIG. 9) defines vertical grooves 65 in its side walls, and the ends 67 of wings 40 are received in these grooves. This prevents any appreciable lengthwise movement of the rocker, it being understood that the widths of grooves 65 are such that pivoting movement of the rocker is not restrained.

Figure 4:
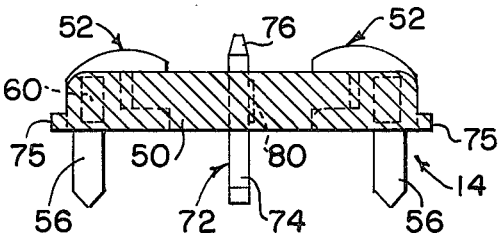
FIG. 4 is a cross-sectional view of the base taken about the line 4—4 of FIG. 2.
Figure 5:
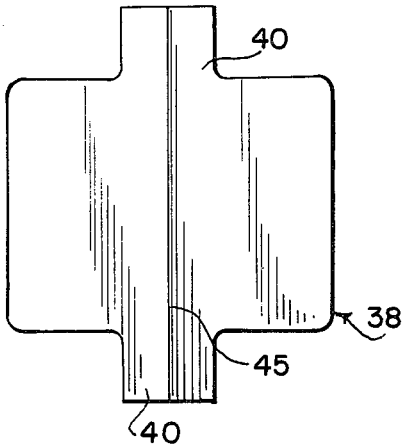
FIG. 5 is a plan view of the rocker element utilized in the slider assembly of FIG. 1.

The base assembly 14 comprises base 50 in combination with a plurality of terminal elements which have integrally formed contact surfaces. As best shown in FIG. 4, these terminal elements include first elements 52 having terminal portions 56, these being designed for insertion in a printed circuit board. It will be appreciated that the terminals could define lugs for attachment of leads for use other than in association with printed circuit boards.

The upper curved surfaces 58 of the terminal elements serve as the contact portions of the terminal elements. The terminal elements 52 include protrusions 60 formed in one side wall. As explained in the aforementioned Spedale application, the base 50 defines slots, and recesses are defined in one side wall of each slot. The elements 52 are adapted to be press fit into the slots, and the protrusions 60 in combination with the recesses serve to lock the elements in place.

Center terminal elements 72 define terminal portions 74, and upwardly extending portions 76 which define contact surfaces and also serve as fulcrum means in the switch operation. The base defines slots and recesses with protrusions 80 defined by the terminal elements 72 provide for locking of these elements into position on the base 50.

Figure 10:
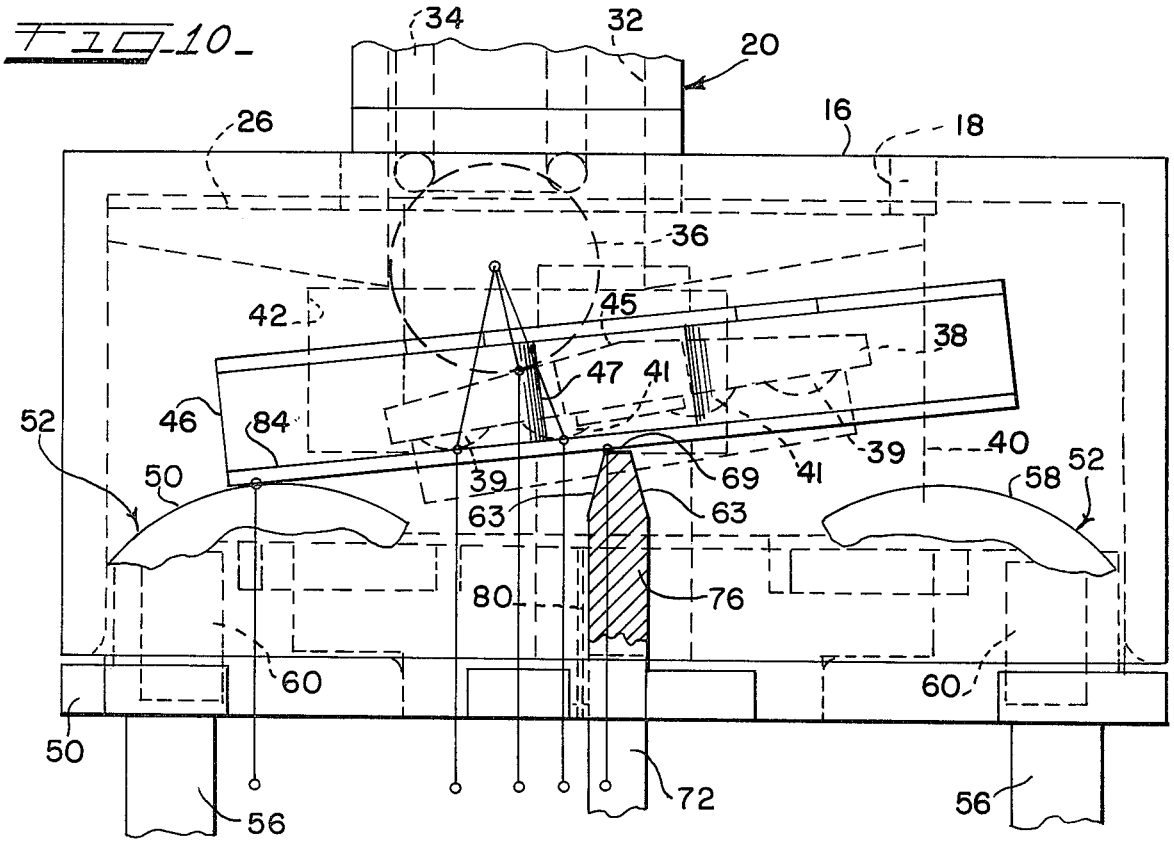
FIG. 10 is a partially schematic illustration of the switch construction, in elevation and partly cut away, indicating the contact points involved in the switch operation; and, FIG. 11 is a partially schematic illustration of the switch constructions, in end elevation and partly cut away, indicating the contact points involved in the switch operation.

Each of the fulcrum contacts 72 includes a pair of engaging edges comprising the juncture of the angled surfaces 63 and flat top surface 69. As best shown in FIG. 10, the bridging contactors will have a line of engagement with the fulcrum contacts as defined by one of these edges, depending upon the position of the switch.

The base 50 defines a pair of locking tabs 71 on each side. Locking tab windows 73 are in turn defined by the enclosure 30. The top assembly and base assembly are interconnected by pressing the two together so that the tabs 71 will be received within the windows 73. Flange elements 75 are formed integrally with the base 50, and the positions of the tabs 71 and windows 73 are such that the bottom edge of the enclosure 30 will be located against the flange 75 when the top and base assemblies are interconnected.

It will be appreciated that in the operation of the switch construction illustrated, the slider 20 is manually operated, although some means for automatically achieving the slider movement is, of course, feasible. It will also be appreciated that the invention is not limited to the particular arrangement wherein the ball and spring develop a spring loaded actuating force. As previously indicated, various toggle, piston, rocker, and hammer actuated switch designs could be utilized for purposes of achieving a suitable actuating force.

Figure 9:
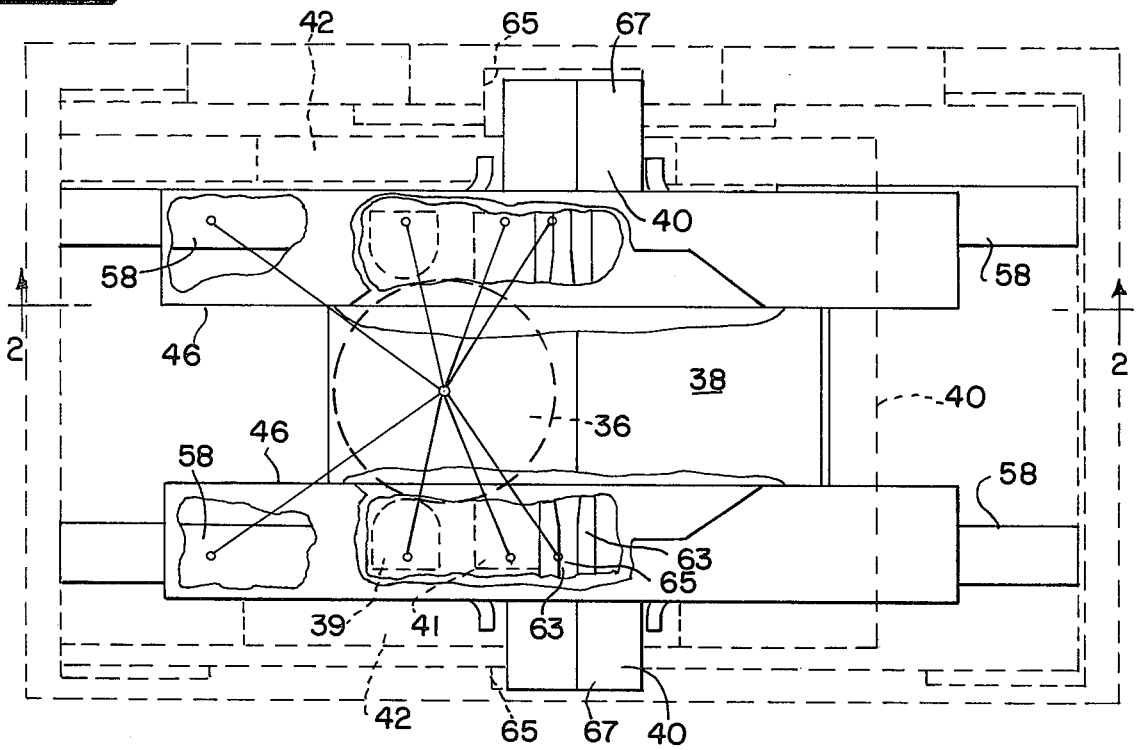
FIG. 9 is a partially schematic illustration of the switch construction, in plan view and partly cut away, indicating the contact points involved in the switch operation.
Figure 11:
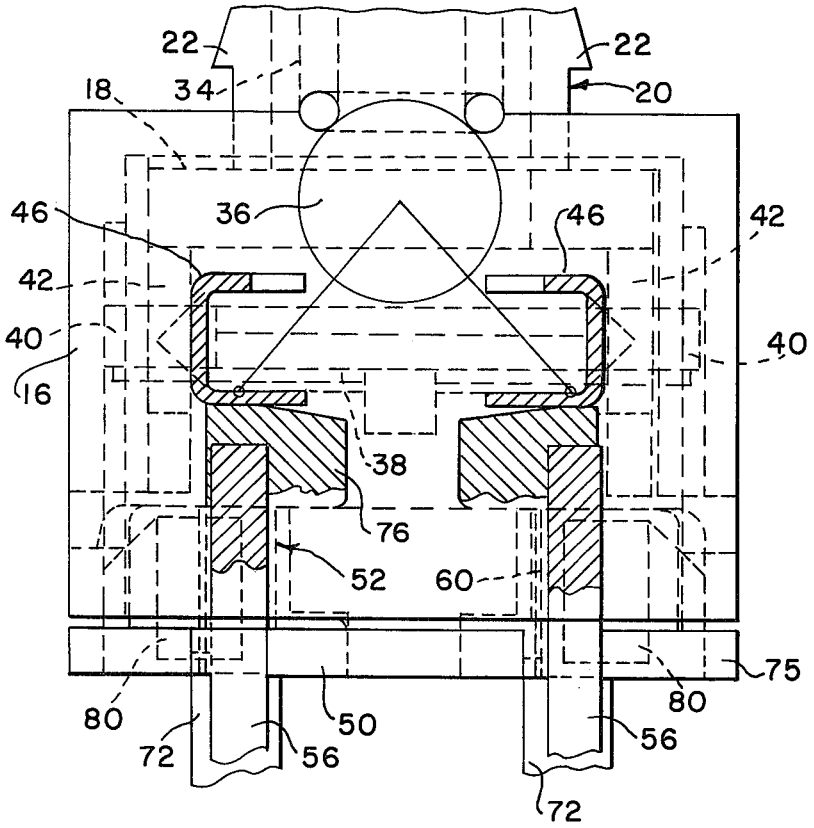

The actuating mechanisms apply pressure to the rocker 38 and, as shown in FIGS. 9–11, this pressure is transmitted to the bridging contactors and then through the contactors to the end and fulcrum contacts. The lines drawn from the center of the ball 36, in particular, illustrate that the beads 39 are adapted to bear directly against the inner wall 84 of the channel-shaped bridging contactors. Similarly, the curved sections 41 are designed for engagement with this inner wall.

The force applied by the rocker to a bridging contactor is transmitted by the contactor to a contact point on a contact element 52, as shown, and to a line of contact with the fulcrum terminal, again in the manner shown.

If the slider 20 is moved from left to right, this places the ball 36 on the other side of rocker 38, and this action automatically results in pivoting of the bridging contactors whereby these contactors will engage the opposite pair of contacts 52. To achieve this switching, the ball 36 climbs the slope on one side of the crest 45, and this crest is slightly over-center. Accordingly, when the ball 36 reaches this position, the force components are such that the rocker will be rapidly pivoted into the new position.

The opening 47, being wider than the width of the wings 40, permits shifting of the rocker relative to the bridging contactors during each switching operation. Accordingly, the crest 45 is shifted over-center relative to the fulcrum elements 72 whereby the switch becomes set for the next switching operation. This over-center arrangement is particularly suitable for achieving rapid switch movement and for preventing "teasing".

Figure 6:
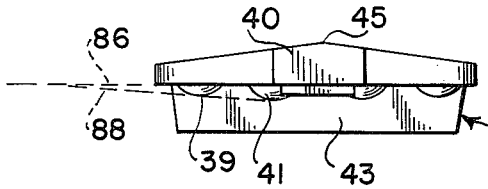
FIG. 6 is an end elevation of the rocker element.
Figure 7:
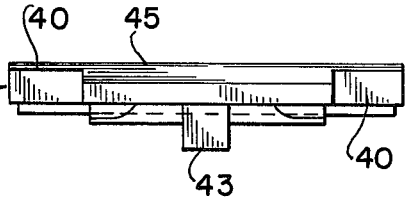
FIG. 7 is a side elevation of the rocker element.
Figure 8:
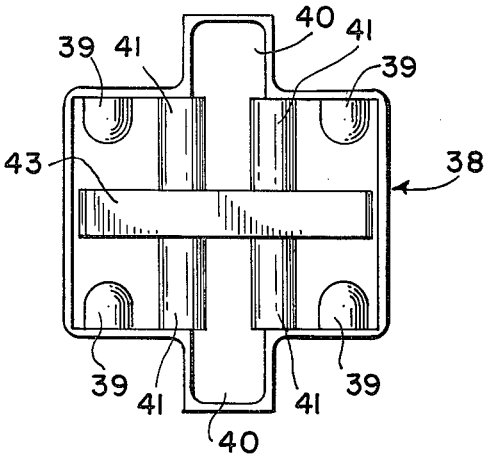
FIG. 8 is a bottom plan view of the rocker element.

As best illustrated in FIG. 6 by the dash lines 86 and 88, the curved elements 41 extend downwardly from the rocker 38 for a greater distance than the beads 39. Accordingly, a line 86 in the plane of the bottom surface of rocker 38 intersects the line 88 which is in a plane coinciding with the contact surfaces of the elements 41 and beads 39.

This relationship of the elements 41 and beads 39 provides an operating sequence in the switch which insures a highly effective making and breaking operation. Referring to FIG. 10 and considering movement of the slider 20 from left to right, it will be appreciated that the right-hand element 41 will engage the inner wall 84 prior to engagement of that wall by the right-hand bead 39. The element 41, in fact, serves to break contact of the bridging contactor 46 with the left-hand terminal element 52 and initiates movement of the bridging contactor toward the right-hand terminal element 52. The right-hand bead 39 is also forced against the surface 84 and acts as a positive means for making contact between the bridging contactor and the right-hand element 52.

The structure described constitutes a "double hammer" in that an element 41 and subsequently a bead 39 are driven against a bridging contactor during each switching operation. The first hammer tends to provide a rapid break, and the second hammer provides an accelerated make of the switch.

The rocker design, particularly with reference to the beads 39 and curved elements 41, insures good electrical contact between engaged pairs of contacts and the fulcrum contacts. In this connection, it is not critical that the contacts 58, rocker 45, and bridging contactors 46 have a strict dimensional relationship. In fact, the freedom of movement which is allowed due to the relative sizes of the openings 47 and the wings 52 is important in this respect. If it is assumed that one of the pairs of contacts 52 is in a different plane than the other contact of that pair, the bridging contactors and rocker will automatically accommodate for this condition. Specifically, one of the bridging contactors might be tilted at an angle sufficiently different from that of the other whereby two-point engagement with the rocker by that contactor is not possible. There will, however, always be at least one of the elements 39 and 41 engaging the specific bridging contactor at a given time. The arrangement described in effect achieves a "three-legged stool" condition. Thus, in all instances, the bridging contactor arrangement results in at least three points of contact with respect to the two bridging contactors.

Once engagement with the bridging contactors is assured on the highly reliable basis, the contact with the terminal surfaces 58 and fulcrum end 65, is always achieved. In this connection, the line contact with the fulcrum will not affect the engagement of the bridging contactor with contact 52 since only a point contact is necessary in that area. It is also important that the bridging contactors are attached to adjust relative to the wings 40 in various ways including pivoting movement about the longitudinal axis of the bridging contactors as well as pivoting movement about the pivot axis of the rocker.

The switch construction in addition to being highly reliable from an electrical standpoint, is also characterized by durability. Thus, the rocker and bridging contactors which comprise the parts most subject to wear and distortion are both designed in a strong fashion. The channel-shaped design of the bridging contactors and the use of the rib 43 for the rocker give strength to these components particularly in the area of the switch most subject to the application of operating forces. In this connection, the use of the spring loaded ball in conjunction with the rocker design provides a desirable arrangement in that severe impact forces which often characterize switches, such as hammer operated switches, are avoided.

It will be understood that various changes and modifications may be made in the switch construction described without departing from the spirit of this invention, particularly as defined in the following claims.

That which is claimed is:

1. In a switch construction comprising a base, spaced-apart contacts having exposed contact surfaces attached to said base, at least one fulcrum contact positioned on said base between said spaced-apart contacts, said fulcrum contact extending outwardly from said base beyond the extent of said spaced-apart contacts, a bridging contactor engaging said fulcrum contact and extending on either side of the fulcrum contact for engagement with one or the other of said spaced-apart contacts upon pivoting movement of the bridging contactor, and a spring-loaded actuator for pivoting said bridging contactor, the improvement wherein said bridging contactor comprises a substantially non-resilient elongated member, said actuator including a substantially non-resilient rocker engaging said bridging contactor and being mounted for pivoting movement relative to said bridging contactor, operation of said actuator resulting in pivoting movement of said rocker relative to said bridging contactor whereby said rocker is driven against said bridging contactor to pivot said bridging contactor.

2. In a switch construction comprising a base, first and second pairs of spaced-apart contacts having exposed contact surfaces attached to said base, a pair of fulcrum contacts positioned on said base between said first and second contacts, said fulcrum contact extending outwardly from said base beyond the extent of said first and second spaced-apart contacts, a pair of bridging contactors engaging said fulcrum contacts and extending on either side of the fulcrum contacts for selective engagement with said first and second pairs of contacts upon pivoting movement of the bridging contactors, and a spring-loaded actuator for pivoting said bridging contactors, and improvement wherein said bridging contactors each comprise a substantially non-resilient elongated member, said actuator including a substantially non-resilient rocker engaging said bridging contactors and being mounted for pivoting movement relative to said bridging contactors, operation of said actuator resulting in pivoting movement of said rocker relative to said bridging contactors whereby said rocker is driven against said bridging contactors to pivot said bridging contactors.

3. A construction in accordance with claim 2 wherein said bridging contactors comprise channel-shaped members, openings defined by the base section of each channel-shaped member, said rocker having wing sections received in said openings to achieve support of said bridging contactors by said rocker.

4. A construction in accordance with claim 3 wherein said openings are larger than said wing sections whereby said bridging contactors have a degree of freedom of movement relative to said rocker.

5. A construction in accordance with claim 4 wherein said actuator comprises a spring loaded member engaging the upper surface of said rocker and movable over said upper surface from a position on one side of said fulcrum contacts to a position on the other side of said fulcrum contacts to thereby achieve said pivoting movement, and wherein said rocker shifts relative to said bridging contactors in a direction opposite the direction of movement of said actuator during each pivoting movement.

6. A construction in accordance with claim 5 wherein said actuator comprises a spring loaded ball, said upper surface of said rocker defining a transversely extending centrally located crest, said pivoting movement occurring when said ball is moved to the position of said crest.

7. A construction in accordance with claim 3 including feet defined by said rocker, said feet engaging the inwardly extending bottom side walls of each channel.

8. A construction in accordance with claim 7 wherein said feet define curved surfaces whereby substantially point contact is achieved between said feet and said side walls.

9. A construction in accordance with claim 3 wherein said rocker defines four feet on each side thereof, at least two of said feet engaging the side wall of one of said bridging contactors, and at least one of said feet engaging the side wall of the other of said bridging contactors.

10. A construction in accordance with claim 8 wherein said fulcrum contacts define edges extending transversely of said bridging contactors whereby the bridging contactors are in line contact with each fulcrum contact in each position of the bridging contactors.

11. A construction in accordance with claim 7 wherein said spaced apart contacts define curved contact surfaces for engagement with said bridging contactors.

12. A construction in accordance with claim 7 wherein the contact surfaces of said bridging contactors comprise the bottom surfaces of inwardly facing channel walls, the opposite surfaces of said channel walls defining engaging surfaces for said rocker, and wherein said walls are free for adjusting movement during each pivoting operation whereby engagement of said bridging contactor by said rocker, and contact of said bridging contactor with said spaced-apart contacts and with said fulcrum contacts, is assured in each position of the switch.

13. A construction in accordance with claim 9 wherein inner pairs of said feet extend outwardly from said rocker a greater distance than outer pairs of said feet whereby the inner pairs are adapted to engage bridging contactors during a switching operation prior to the outer pairs, the rocker being pivoted about said inner pairs during the switching operation whereby the outer pairs are driven against the bridging contactor as a result of such pivoting.

* * * * *